US005374067A

United States Patent [19]

Jones

[11] Patent Number: 5,374,067

[45] Date of Patent: Dec. 20, 1994

[54] METHOD FOR PLAYING A CARD GAME

[76] Inventor: Daniel A. Jones, 5520 W. Del Rey, Las Vegas, Nev. 89102

[21] Appl. No.: 74,301

[22] Filed: Jun. 9, 1993

Related U.S. Application Data

[60] Continuation-in-part of Ser. No. 800,631, Nov. 27, 1991, Pat. No. 5,288,077, which is a continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,836,553.

[51] Int. Cl.[5] ..... A63F 1/90

[52] U.S. Cl. ..... 273/292; 273/85 CP

[58] Field of Search ..... 273/292, 274, 309, 85 CP

[56] References Cited

U.S. PATENT DOCUMENTS

| | | | |
|---|---|---|---|
| 1,238,736 | 9/1917 | Barrett | 193/2 |
| 1,527,929 | 2/1925 | Simons | 273/274 |
| 1,763,476 | 6/1930 | Morris | 273/309 |
| 3,269,503 | 8/1966 | Foster | 273/85 CP |
| 3,663,021 | 5/1972 | Whippo | 273/292 |
| 3,667,757 | 6/1972 | Holmberg | 273/274 |
| 3,825,255 | 7/1974 | Kennard et al. | 273/138 A |
| 3,876,208 | 4/1975 | Wachtler et al. | 273/138 A |
| 4,232,866 | 11/1980 | Pennachio | 273/374 |
| 4,305,586 | 12/1981 | Richards | 273/374 |
| 4,364,567 | 12/1982 | Goott | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,614,342 | 9/1986 | Takashima | 273/85 CP |
| 4,648,604 | 3/1987 | Horan | 273/292 |

(List continued on next page.)

FOREIGN PATENT DOCUMENTS

| | | | |
|---|---|---|---|
| 338644 | 10/1989 | European Pat. Off. | 273/292 |
| 2830216 | 1/1980 | Germany . | |
| 3003376 | 8/1981 | Germany . | |
| 2184029 | 6/1987 | Germany . | |
| 2169736 | 7/1986 | United Kingdom | 273/85 CP |

OTHER PUBLICATIONS

Scarne's Encyclopedia of Games, "Stud Poker", Harper & Row Publishers, 1973, pp. 34–37.

Casino Journal, vol. 8, No. 12, Dec. 1992 "Working within the systems: IGT'linked progressive programs take leap to the tables" pp. 10–15, 40, 41.

Casino Gaming Sep. 1988 pp. 12–13 "Aruba Deals a New Game: Caribbean Stud Poker".

State of New Jersey Casino Control Commission PRN 217205 Civil Action IGT's.

(List continued on next page.)

*Primary Examiner*—Benjamin H. Layno

[57] ABSTRACT

The disclosed card game variant enables players to compete in the familiar format of a rummy-type game against the house. In a preferred five-card embodiment, players initially ante, then receive four cards face down from the dealer, while the dealer received three cards face down and one card face up. Players electing to continue play after a bet or fold option and the dealer each receive one more card face down to complete a five card hand. The point count total of the hand of each remaining player and the dealer are then determined and compared, with each Ace counting 1, each deuce counting 2, etc., and with tens and face cards each counting 10. Each spread consisting of three or more suited cards in sequence or three or four of a kind counts zero (0). The object of the game is to have a lower point count total than the dealer. The dealer only plays when his hand totals 32 or lower. Any player possessing a hand having a point count total less than that of the dealer's hand wins and receives a payout, with hands having some predetermined point totals receiving a bonus amount designated in a payout table. If the dealer's hand totals more than 32, then each player is paid 1 to 1 on his ante and all other bets are cancelled. The game may be played in both live table and electronic video poker formats.

83 Claims, 2 Drawing Sheets

U.S. PATENT DOCUMENTS

| | | | |
|---|---|---|---|
| 4,651,997 | 3/1987 | Wood | 273/274 |
| 4,759,549 | 7/1988 | Beckwith | 273/274 |
| 4,760,527 | 7/1988 | Sidley | 364/412 |
| 4,813,675 | 3/1989 | Greenwood | 273/138 A |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,948,134 | 8/1990 | Suttle et al. | 273/85 CP |
| 5,022,653 | 6/1991 | Suttle et al. | 273/85 CP |
| 5,078,405 | 1/1992 | Jones et al. | 273/309 |
| 5,112,060 | 5/1992 | Jones | 273/309 |

OTHER PUBLICATIONS

Second Amended Petition for the authorization for the implementation of the game of progressive-21 filed some time after Aug. 4, 1992.

Information Disclosure Statement Apr. 7, 1988 Describing "Sklansky's Casino Poker" and Video Poker.

Coin Hopper Model CH-500 and Model Number DH-750/UI literature Asahi Seiko.

26 Jan. 1993, Statement of Grounds and Particulars by John Huxley, Ltd. in opposition to Australian Patent Application No. 628044.

METHOD FOR PLAYING A CARD GAME

CROSS-REFERENCE TO RELATED APPLICATIONS

This is a continuation-in-part of application Ser. No. 07/800,631, filed Nov. 27, 1991 now U.S. Pat. No. 5,288,077; which is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,863,553. The entire disclosures of each of the above referenced applications and patents are hereby incorporated by reference herein.

BACKGROUND OF THE INVENTION

The present invention relates to games, and more particularly pertains to a new type of card game especially adapted for casino gambling, both in live table and electronic video formats.

As a leisure time activity, poker and other card games have fascinated the public for years. A deck of cards, a playing surface and a few participants are all that is needed to provide a recreational few hours away from the stress and strain of daily life. Almost everyone knows how to play some variation of a rummy-type card game in which players attempt to acquire 3 or more card suited runs (such as 4 club, 5 club, 6 club) and sets of 3 or 4 of a kind (such as 4 club, 4 diamond, 4 spade) in order to make a play or so-called "spread".

Many places, both within and without the United States, have legalized gaming and poker is one of the games of chance that is offered in both casinos and cardrooms. In a conventional cardroom poker game, the house provides a dealer, the playing cards, the table and chairs but does not play a hand. The house collects a nominal percentage of each player's bet (the "rake") which compensates the house for providing the facilities to the players. Alternatively, the house may charge each player a set amount per hand or for a specified length of time, say one-half hour. Each player is competing not against the house, but against all the other players with the highest hand winning the total of all the wagers made on that hand.

Many people do not like to play cardroom poker because each player is competing against his fellow players, not against the house. Many people would rather attempt to win money from an impersonal source, the house or the casino, rather than from their fellow players with whom they may be acquainted.

Cardroom poker also does not offer any bonus payments for particularly good hands. While a Royal Flush is a rare occurrence and generates a thrill for any poker player, the player collects the same total wager that he would have collected if all he needed to beat the other players was Three of a Kind.

Casino card game variants are known in which the players each compete against the dealer or house, rather than against each other. Blackjack or Twenty-One is an example of such a game. Many people are relatively unfamiliar with the game of Blackjack, since this game is not frequently played in home environments on a recreational basis. Thus, many people are reluctant to participate in Blackjack games when visiting a casino.

SUMMARY OF THE INVENTION

The present invention discloses a card game variant which enables players to compete in the familiar format of a rummy-type game against the house. In a preferred five-card embodiment, players initially ante, then receive four cards face down from the dealer, while the dealer received three cards face down and one card face up. Players electing to continue play after a bet or fold option and the dealer each receive one more card face down to complete a five card hand. The point count total of the hand of each remaining player and the dealer are then determined and compared, with each Ace counting 1, each deuce counting 2, etc., and with tens and face cards each counting 10. Each spread consisting of three or more suited cards in sequence or three or four of a kind counts zero (0). The object of the game is to have a lower point count total than the dealer. The dealer only plays when his hand totals 32 or lower. Any player possessing a hand having a point count total less than that of the dealer's hand wins and receives a payout, with hands having some predetermined point count totals receiving a bonus amount designated in a payout table. If the dealer's hand totals more than 32, then each player is paid 1 to 1 on his ante and all other bets are cancelled. The game may be played in both live table and electronic video poker formats.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
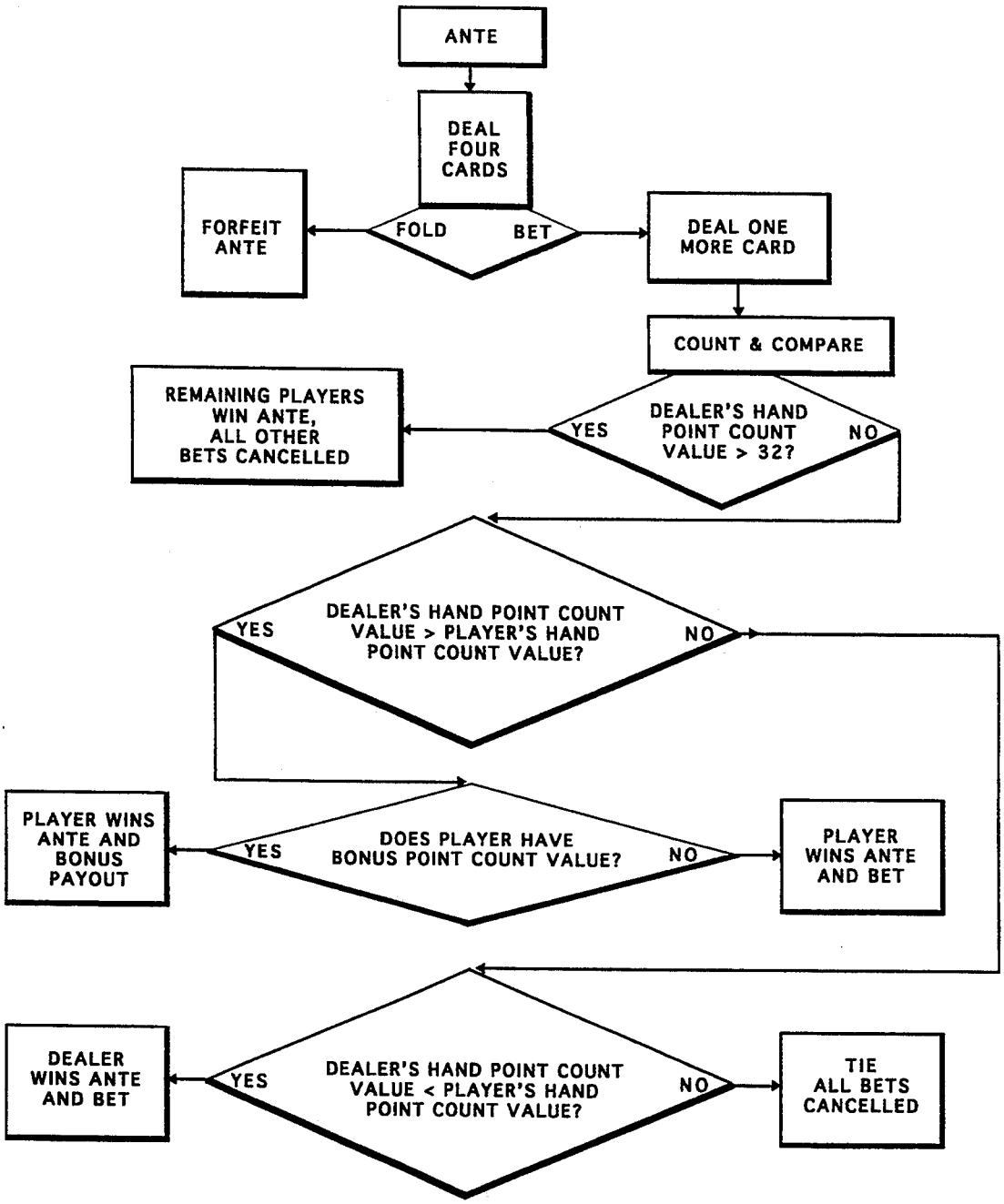
FIG. 1 is a flow chart illustrating the method of playing a card game according to the present invention.

With reference to FIG. 1 the manner of play of a preferred embodiment of the card game of the present invention will now be described. The game may be played in a live table version employing a live human dealer and a gaming table and layout similar to those employed by casinos in the conventional live table version of Twenty-One. In such a live table version, one or more players sitting or standing in respective player locations spaced about the periphery of the gaming table initially make so-called "ANTE" wagers of a predetermined amount or within a predetermined range set by the house (casino) in accordance with applicable gambling laws and regulations. The wagers are preferably made by placing associated chips or other tokens in a bet box or other designated token receiving location or acceptor. After each player has placed the "ANTE" wager, the dealer, preferably a suitably registered and certified casino employee, then deals four cards face down to each player. The dealer also receives four cards: three face down and one face up. Thus, after the initial four card deal, players have knowledge of one of the dealer's cards to assist them in subsequent wagering decisions.

In the live casino version, the cards are preferably dealt from a single conventional fifty-two card deck which is reshuffled after every hand. Alternatively, a deck shoe consisting of a plurality of ordinary fifty-two card decks shuffled together may be employed in order to minimize reshuffling time between hands.

After the initial four card deal, players inspect their own four cards and the one face-up card of the dealer's hand and then make a decision of whether to quit the hand and forfeit their ante wager ("FOLD") or place an additional wager to continue participating in the hand ("BET"). Preferably, the additional wager is an amount larger than the initial ante wager, for example double the ante wager. After each player in turn has elected whether to either FOLD or BET, the dealer deals one additional card face-down to each remaining player. The dealer also receives an additional face-down card, such that each remaining player and the dealer now possess a five card hand.

Each remaining player and the dealer now count the point count total of their hands and compare with the point count total of the dealer's hand. During this comparison, each remaining player and the dealer preferably turn all the cards in their hand face-up. The point count value of the cards are set forth in the following table:

TABLE 1

| Point Values of Cards | |
|---|---|
| Card | Point Value |
| Ace (any suit) | 1 |
| deuce (any suit) | 2 |
| 3 (any suit) | 3 |
| 4 (any suit) | 4 |
| 5 (any suit) | 5 |
| 6 (any suit) | 6 |
| 7 (any suit) | 7 |
| 8 (any suit) | 8 |
| 9 (any suit) | 9 |
| 10 (any suit) | 10 |
| Jack (any suit) | 10 |
| Queen (any suit) | 10 |
| King (any suit) | 10 |

For purposed of counting the point count value of a hand, any set of three or four of a kind and any suited three or more card run count zero. Aces count one point and play only low. Thus, Ace-2-3 suited comprises a run, but Ace-King-Queen suited does not.

The dealer initially determines whether the point count value of his or her hand is more than thirty-two (32). If the dealer's point count value is greater than thirty-two then all remaining players (all those who didn't FOLD) each receive a one-to-one payout on their initial ante wager, all other bets are cancelled. If the dealer's point count value is less than or equal to thirty-two (32), then the point count value of each player's hand is compared to the point count value of each remaining player's hand to determine whether each player wins or loses. If the point count value of the dealer's hand is greater than the point count value of the player's hand, then than particular player wins his or her ante and additional wagers. Each winning player must then ascertain whether they possess one of the bonus point count values set forth in the following table:

TABLE 2

| Payoff Odds | |
|---|---|
| Point Count of Player's Hand | Payoff Odds |
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |
| 0 | 100 to 1 |
| All other | 1 to 1 |

Any player possessing one of the bonus point count total values listed above receives a one-to-one payout on their ante wager and the listed bonus payoff on their additional bet. For example, if the ante wager were $1.00 and the additional bet $2.00, then a winning player possessing a hand having a point count total value of six (6) would receive a $2.00 payback on their $1.00 ante bet and an $8.00 payback (four-to-one) on their $2.00 additional bet, for a total payback of $10.00.

Any winning player not possessing a bonus point count total value receives a one-to-one payoff on both their ante and additional wagers.

If the dealer's hand has a point count total value less than a particular player's point count total value, then the dealer (house or casino) wins that particular player's ante and additional wagers.

In the event that the dealer's hand has a point count total value equal to a particular player's point count total value, then both the ante and additional bets with respect to that particular player are cancelled (i.e., a tie or "push").

Some example hands will be considered in order to convey a full and complete understanding of the game.

EXAMPLE 1.

PLAYER #1:A club, 5 heart, 5 diamond, 5 spade, 3 heart

PLAYER #2:Q heart, 6 heart, K spade, 8 diamond, 4 club

PLAYER #3:4 spade, 4 diamond, 4 heart, J club, 9 spade

DEALER: A heart, J diamond, 10 spade, 6 club, 2 heart

The DEALER has no spreads and a point count total value of twenty-nine (29). Accordingly, there is full "action" on all ante and additional bets because twenty-nine (29) is less than thirty-two (32). PLAYER #1 has a point count total value of four (4) because the three card set of fives count zero (0), and thus wins the ante bet and receives an eight-to-one payoff on the additional bet. PLAYER #2 has a point count total value of thirty-eight (38), and thus loses all bets. PLAYER #3 has a point count total value of nineteen (19) because the three card set of fours count zero (0), and thus wins the ante bet and receives a two-to-one payoff on the additional bet.

EXAMPLE 2.

PLAYER #1:A club, 5 heart, 5 diamond, 5 spade, 3 heart

PLAYER #2:Q heart, 6 heart, K spade, 8 diamond, 4 club

PLAYER #3:4 spade, 4 diamond, 4 heart, J club, 9 spade

DEALER: A heart, J diamond, 10 spade, K club, 2 heart

The DEALER has no spreads and a point count total value of thirty-three (33), greater than the dealer's cut-off point count total value of thirty-two (32). Accordingly, remaining players #1, #2, and #3 each win their ante wagers, and all other bets are cancelled.

EXAMPLE 3.

PLAYER #1:A club, 4 heart, 5 heart, 6 heart, 3 heart

PLAYER #2:Q heart, 6 heart, K spade, K diamond, K club

PLAYER #3:7 spade, 7 diamond, 7 club, J club, 9 spade

DEALER: A spade, 2 spade, 3 spade, 4 spade, 5 spade

The DEALER has a five-card spread and a point count total value of zero (0). Accordingly, there is full "action" on all ante and additional bets because zero (0) is less than thirty-two (32). PLAYER #1 has a point count total value of one (1) because the four card heart run counts zero (0), and thus loses both the ante bet and the additional bets. PLAYER #2 has a point count total value of sixteen (16) because the three-card set of Kings counts zero (0), and thus also loses all bets. PLAYER #3 has a point count total value of nineteen (19) because the three card set of sevens count zero (0), and thus also loses all bets.

The one face-up card in the dealer's hand at the time of the fold or bet option provides some information to the players to assist them in deciding whether to fold or bet. For example, if the dealer's face-up card is a King, then a player might speculate that the King more likely than not will not be part of a spread and thus must ultimately be counted. If the player's highest card has a point count value less than, or significantly less than, ten (10), then the player might be encouraged to place an additional wager rather fold.

As can now be appreciated, the present invention presents players with the opportunity to make a slightly educated "guess" when deciding the bet or fold option.

The present invention, in addition to the live table casino version of the game described above, also contemplates an electronic video game version employing a device similar to the conventional electronic video poker device commonly employed in casinos. One such device of the general type suitable for use in the practice of the game according to the present invention is disclosed in U.S. Pat. No. 4,948,134, which issued Aug. 14, 1990, and the entire disclosure of which is incorporated by reference herein.

Figure 2:
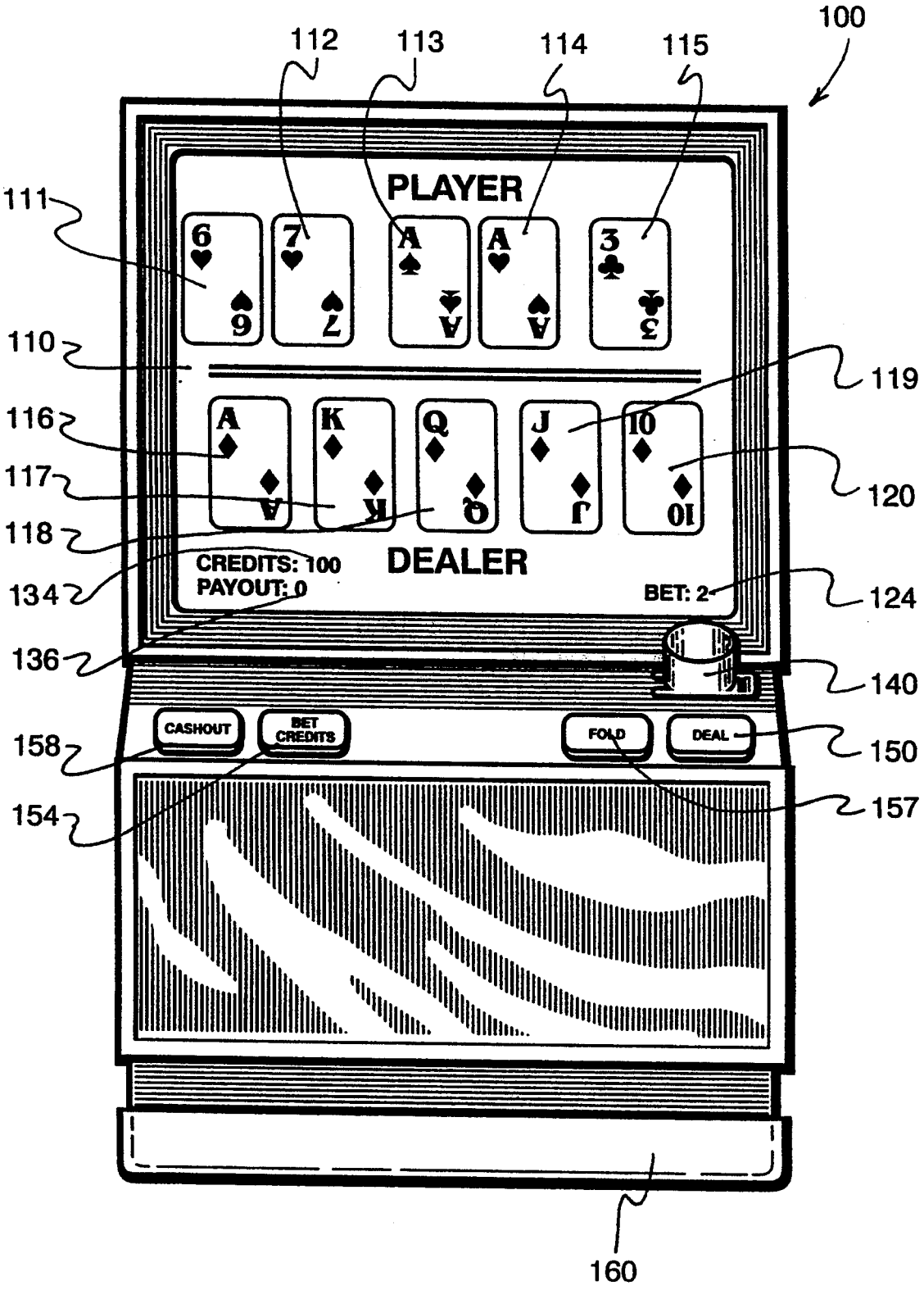
FIG. 2 is a front elevational view of an electronic video game device for playing the card game according to the present invention.

As depicted in FIG. 2, the electronic video poker device 100 includes a display screen 110 operative in a well known manner to display representations of conventional playing cards thereon. In accordance with the present invention, the CPU (not shown) of the device 100 is instructed pursuant to a program which may, for example, be stored in a PROM component of the internal circuitry. The PROM stored program code may be selectively determined, within the ambit of a programmer of ordinary skill in the art, having the benefit of the instant disclosure, to enable the electronic device 100 to play the game described above, as diagrammatically illustrated in the flow chart of FIG. 1. An upper portion of the screen 110 designated by the indicia "PLAYER" is operative to display, face-up, an initially incomplete player hand consisting of four cards. Four example, the player hand may initially consist of screen card representations 111, 112, 113, 114. After the last card is "dealt", screen card representation 115 will appear. In accordance with generally known technology in the field of video poker machines, the CPU of the device 100, under appropriate program instruction, may accurately simulate the random dealing of the hand from a shuffled conventional fifty-two card deck.

A lower portion of the screen 110, designated by the indicia "DEALER" is similarly operative to display representations of five communal cards 116, 117, 118, 119, and 120. After the initial deal, four card representations will appear, with only one being face-up. Thus, after the initial deal, an individual playing the game of the present invention of the device 100 will see only one of the dealer's cards. An LED display 124 displays the value of the current bet, for example 2 tokens (which tokens may represent, for example, nickels, dimes, quarters, dollars, etc.) and similar LED displays 134 and 136 display the number of accumulated credits (i.e. tokens) and the number of tokens paid out, respectively. A coin acceptor 140 is operative to receive wager tokens, or alternatively, coins and/or bills. A plurality of control buttons 150, 154, 157, and 158 allow the player to make control inputs during play of the game of the present invention. In an example manner of play of the electronic video poker device 100, a player first puts tokens or coins into the acceptor 140 to acquire a credit balance on LED CREDIT display 134. If so desired, the player may alternatively place each bet individually after each hand by inserting coins, tokens, or bills. The player then pushes the BET CREDITS button 154 one or more times to place an ante wager which is displayed by BET display 124. The electronic device 100 may be programmed to limit the number of tokens that can be bet on a single hand to, for example, five. After the player is satisfied with the amount bet, the player pushes the DEAL button 150, which causes the device 100 to "deal" face-up four cards 111, 112, 113, and 114 of the PLAYER hand and to deal four cards 116, 117, 118, and 119 of the DEALER hand, three face-down and one face-up. The player then determines whether to FOLD or BET. If the player wishes to FOLD, then button 157 is pushed. If the player wishes to continue the hand, the BET CREDITS button 154 is pushed one or more times or addition tokens or inserted into coin acceptor 140. After the player is satisfied with the amount bet, the player then again pushes the DEAL button 150, causing the device 100 to "deal" one addition card 115 face-up in the PLAYER hand display zone and to also deal one additional card 120 to the DEALER hand display zone while also turning all of the DEALER hand cards face-up. The device 100 may be programmed to suitably prompt the player for required control inputs during the course of play. For example, one or more of the control buttons may flash when activation of such buttons is a current player option or input requirement. The device 100 then automatically counts and compares the point count value of the PLAYER and DEALER hands and determines whether the player wins, loses or ties and makes an appropriate electronic or physical settlement of the wager. The device 100 may be programmed to make appropriate bonus payouts in accordance with the odds set forth in Table 2 above. Paid out coins or tokens may be dispensed into tray 160 for collection or storage by the player. When a player wishes to cease play, any accumulated credits may be refunded by depressing the CASHOUT button 158.

In addition to the example embodiment of the invention described in detail above, other variants may also be practiced within the scope of the present invention. Instead of consisting of three cards, the initially incomplete dealer and player hands after the initial deal may possess a greater or lesser number of cards. Also, the number of cards in the final completed hands may be more or less than five.

It is further contemplated that the game disclosed herein may include a progressive jackpot feature, as disclosed in U.S. Pat. No. 4,861,041 issued to Daniel A. Jones and James P. Suttle on Aug. 29, 1989, the entire disclosure of which is hereby incorporated by reference herein. As described in U.S. Pat. No. 4,861,041, the progressive jackpot feature entails a separate jackpot wager, for example by placing a chip or betting token in a slot in or adjacent to the gaming table or electronic video poker machine, apart from the bets associated with the usual play of the game. If the winning hand comprises a predetermined arrangement of cards, a player selecting the winning hand wins at least a portion of the jackpot. This may be either a fixed amount of chips or tokens, or a percentage of the current jackpot total value.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of playing a card game, comprising the steps of:

providing a deck of playing cards including a plurality of different card suits with each suit including a plurality of cards having different point values;

dealing at least one initially incomplete player hand consisting of a first predetermined number of said playing cards;

dealing at least one initially incomplete dealer hand consisting of a second predetermined number of said playing cards;

providing an option to either place a bet or fold to at least one player;

dealing at least one more card to said dealer hand and to each remaining player hand;

adding point values of the cards in said dealer hand and each remaining player hand according to predetermined card point values in which at least one predetermined multi-card arrangement of cards has a zero point count value to determine point count total values for said dealer hand and each remaining player hand; and comparing said point count total values of said remaining player and dealer hands to determine the winner between the dealer and each remaining player.

2. The method of claim 1, wherein said first predetermined number of cards consists of four cards.

3. The method of claim 1, wherein said second predetermined number of cards consists of four cards.

4. The method of claim 1, wherein said first and second predetermined numbers of cards each consists of four cards.

5. The method of claim 1, wherein each of said completed player and dealer hands consists of five cards.

6. The method of claim 1, wherein cards in said at least one player hand are dealt face-up.

7. The method of claim 1, wherein at least one card in said dealer hand is dealt face-up.

8. The method of claim 1, wherein at least one card in said dealer hand is dealt face-down.

9. The method of claim 1, wherein said deck of playing cards is divided into at least four different suits, with each suit including a plurality of sequentially denominated cards, and said predetermined multi-card arrangement comprises three or four of a kind.

10. The method of claim 1, wherein said deck of playing cards is divided into at least four different suits, with each suit including a plurality of sequentially denominated cards, and said predetermined multi-card arrangement comprises a run of three or more sequential suited cards.

11. The method of claim 1, wherein a plurality of predetermined multi-card arrangements of cards have a zero point count value.

12. The method of claim 11, wherein said deck of playing cards is divided into at least four different suits, with each suit including a plurality of sequentially denominated cards, and said plurality of predetermined multi-card arrangements of cards comprise three or four of a kind and runs of three or more sequential suited cards.

13. The method of claim 1, further comprising the step of each player placing an ante wager before said step of dealing at least one initially incomplete player hand.

14. The method of claim 1, further comprising the step of settling bets with remaining players after said step of comparing.

15. The method of claim 14, wherein said step of settling bets includes the step of paying each winning player according to the odds set forth in the following table depending upon the point count value of each winning player hand:

| Point Count Value of Winning Hand | Payoff Odds |
|---|---|
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |
| 0 | 100 to 1 |
| All other | 1 to 1 |

16. The method of claim 14, wherein said step of settling bets includes the step of paying each winning player a bonus amount depending upon the point count value of each winning player hand.

17. The method of claim 1, wherein said game is played on an electronic device and said cards comprise electronically produced visual representations of playing cards.

18. The method of claim 1, wherein said game is played in a live form on a gaming table with a human dealer and conventional playing cards.

19. The method of claim 1, further comprising the step of cancelling said bets if the dealer hand does not achieve a predetermined point count value.

20. The method of claim 1 wherein a plurality of predetermined multi-card arrangements of cards have a zero point count value.

21. The method of claim 20 wherein said deck of playing cards is divided into at least four different suits, with each suit including a plurality of sequentially denominated cards, and said plurality of predetermined multi-card arrangements of cards comprise three or four of a kind and runs of three or more sequential suited cards.

22. A method of playing a card game, comprising the steps of:

providing a deck of playing cards including a plurality of different card suits with each suit including a plurality of cards having different point values;

dealing at least one initially incomplete player hand consisting of a first predetermined number of said playing cards;

dealing at least one initially incomplete dealer hand consisting of a second predetermined number of said playing cards;

providing an option to either place a bet or fold to at least one player;

dealing at least one more card to said dealer hand and to each remaining player hand;

adding point values of the cards in said dealer hand and each remaining player hand according to predetermined card point values to determine point count total values for said dealer hand and each remaining player hand;

comparing said point count total values of said remaining player and dealer hands to determine the winner between the dealer and each remaining player; and settling bets with remaining players after said step of comparing according to the odds set forth in the following table depending upon the point count value of each winning player hand:

| Point Count Value of Winning Hand | Payoff Odds |
|---|---|
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |
| 0 | 100 to 1 |
| All Other | 1 to 1 |

23. The method of claim 22, wherein said first predetermined number of cards consists of four cards.

24. The method of claim 22, wherein said second predetermined number of cards consists of four cards.

25. The method of claim 22, wherein said first and second predetermined numbers of cards each consists of four cards.

26. The method of claim 22, wherein each of said completed player and dealer hands consists of five cards.

27. The method of claim 22, wherein cards in said at least one player hand are dealt face-up.

28. The method of claim 22, wherein at least one card in said dealer hand is dealt face-up.

29. The method of claim 22, wherein at least one card in said dealer hand is dealt face-down.

30. The method of claim 22, wherein at least one predetermined multi-card arrangement of cards has a zero point count value.

31. The method of claim 30, wherein said deck of playing cards is divided into at least four different suits, with each suit including a plurality of sequentially denominated cards, and said predetermined multi-card arrangement comprises three or four of a kind.

32. The method of claim 30, wherein said deck of playing cards is divided into at least four different suits, with each suit including a plurality of sequentially denominated cards, and said predetermined multi-card arrangement comprises a run of three or more sequential suited cards.

33. The method of claim 22, further comprising the step of each player placing an ante wager before said step of dealing at least one initially incomplete player hand.

34. The method of claim 22, wherein said step of settling bets includes the step of paying each winning player a bonus amount depending upon the point count value of each winning player hand.

35. The method of claim 22, wherein said game is played on an electronic device and said cards comprise electronically produced visual representations of playing cards.

36. The method of claim 22, wherein said game is played in a live form on a gaming table with a human dealer and conventional playing cards.

37. The method of claim 22, further comprising the step of cancelling said bets if the dealer hand does not achieve a predetermined point count value.

38. A method of playing a card game, comprising the steps of:

providing a deck of playing cards including a plurality of different card suits with each suit including a plurality of cards having different point values;

dealing at least one initially incomplete player hand consisting of a first predetermined number of said playing cards;

dealing at least one initially incomplete dealer hand consisting of a second predetermined number of said playing cards;

providing an option to either place a bet or fold to at least one player;

dealing at least one more card to said dealer hand and to each remaining player hand;

adding point values of the cards in said dealer hand and each remaining player hand according to predetermined card point values to determine point count total values for said dealer hand and each remaining player hand;

cancelling said bets if the dealer hand does not achieve a predetermined point count total value; and comparing said point count total values of said remaining player and dealer hands to determine the winner between the dealer and each remaining player if the dealer hand achieves said predetermined point count value.

39. The method of claim 38, wherein said first predetermined number of cards consists of four cards.

40. The method of claim 38, wherein said second predetermined number of cards consists of four cards.

41. The method of claim 38, wherein said first and second predetermined numbers of cards each consists of four cards.

42. The method of claim 38, wherein each of said completed player and dealer hands consists of five cards.

43. The method of claim 38, wherein cards in said at least one player hand are dealt face-up.

44. The method of claim 38, wherein at least one card in said dealer hand is dealt face-up.

45. The method of claim 38, wherein at least one card in said dealer hand is dealt face-down.

46. The method of claim 38, wherein at least one predetermined multi-card arrangement of cards has a zero point count value.

47. The method of claim 46, wherein said deck of playing cards is divided into at least four different suits, with each suit including a plurality of sequentially denominated cards, and said predetermined multi-card arrangement comprises three or four of a kind.

48. The method of claim 46, wherein said deck of playing cards is divided into at least four different suits, with each suit including a plurality of sequentially denominated cards, and said predetermined multi-card arrangement comprises a run of three or more sequential suited cards.

49. The method of claim 38, wherein a plurality of predetermined multi-card arrangements of cards have a zero point count value.

50. The method of claim 49 wherein said deck of playing cards is divided into at least four different suits, with each suit including a plurality of sequentially denominated cards, and said plurality of predetermined multi-card arrangements of cards comprise three or four of a kind and runs of three or more sequential suited cards.

51. The method of claim 38, further comprising the step of each player placing an ante wager before said step of dealing at least one initially incomplete player hand.

52. The method of claim 38, further comprising the step of settling bets with remaining players after said step of comparing.

53. The method of claim 52, wherein said step of settling bets includes the step of paying each winning player according to the odds set forth in the following table depending upon the point count value of each winning player hand:

| Point Count Value of Winning Hand | Payoff Odds |
|---|---|
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |
| 0 | 100 to 1 |
| All other | 1 to 1 |

54. The method of claim 52, wherein said step of settling bets includes the step of paying each winning player a bonus amount depending upon the point count value of each winning player hand.

55. The method of claim 38, wherein said game is played on an electronic device and said cards comprise electronically produced visual representations of playing cards.

56. The method of claim 55, wherein said game is played in a live form on a gaming table with a human dealer and conventional playing cards.

57. A method of playing a card game, comprising the steps of:

providing a deck of playing cards including at least four different card suits with each suit including a plurality of sequentially denominated cards, and;

each player initially placing an ante wager;

dealing at least one initially incomplete player hand consisting of four of said playing cards;

dealing at least one initially incomplete dealer hand consisting of four of said playing cards, three face-down and one face-up;

providing an option to either place a bet or fold to each player;

dealing at least one more card to said dealer hand and to each remaining player hand to form completed dealer and player hands;

counting said dealer hand according to predetermined card point count values to determine if the dealer hand possesses more than a predetermined maximum point count total value;

said predetermined card point count values including a plurality of predetermined multi-card arrangements of cards each having a zero point count value, said plurality of predetermined multi-card arrangements of cards comprising three or four of a kind and runs of three or more sequential suited cards;

cancelling all of said additional bets if said dealer hand possesses more than said predetermined maximum point count total value;

if said dealer hand possesses a point count total value equal to or less than said predetermined maximum point count value, counting each remaining player hand according to predetermined card point values to determine a point count total value for each remaining player hand;

comparing said point count total values of said remaining player and dealer hands to determine the winner between the dealer and each remaining player; and settling bets.

58. The method of claim 57, wherein each of said completed player and dealer hands consists of five cards.

59. The method of claim 57, wherein cards in said at least one player hand are dealt face-up.

60. The method of claim 57, wherein said step of settling bets includes the step of paying each winning player according to the odds set forth in the following table depending upon the point count value of each winning player hand:

| Point Count Value of Winning Hand | Payoff Odds |
|---|---|
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |

-continued

| Point Count Value of Winning Hand | Payoff Odds |
|---|---|
| 0 | 100 to 1 |
| All Other | 1 to 1 |

61. The method of claim 57, wherein said step of settling bets includes the step of paying each winning player a bonus amount depending upon the point count value of each winning player hand.

62. The method of claim 57, wherein said game is played on an electronic device and said cards comprise electronically produced visual representations of playing cards.

63. The method of claim 57, wherein said game is played in a live form on a gaming table with a human dealer and conventional playing cards.

64. A method of playing a card game, comprising the steps of:

providing a deck of playing cards including a plurality of different card suits with each suit including a plurality of cards having different point values;

dealing at least one initially incomplete player hand consisting of a first predetermined number of cards;

dealing at least one initially incomplete dealer hand consisting of a second predetermined number of cards;

providing an option to either place a bet or fold to at least one player;

dealing at least one more card to said dealer hand and to each remaining player hand;

counting said remaining player and dealer hands according to predetermined card point values to determine card point total values for said remaining player and dealer hands; and comparing point count total values of said remaining player and dealer hands to determine the winner between the dealer and each remaining player.

65. The method of claim 64, wherein said first predetermined number of cards consists of four cards.

66. The method of claim 65, wherein said second predetermined number of cards consists of four cards.

67. The method of claim 64, wherein said first and second predetermined numbers of cards each consists of four cards.

68. The method of claim 64, wherein each of said completed player and dealer hands consists of five cards.

69. The method of claim 64, wherein cards in said at least one player hand are dealt face-up.

70. The method of claim 64, wherein at least one card in said dealer hand is dealt face-up.

71. The method of claim 64, wherein at least one card in said dealer hand is dealt face-down.

72. The method of claim 64, wherein at least one predetermined multi-card arrangement of cards has a zero point count value.

73. The method of claim 72, wherein said deck of playing cards is divided into at least four different suits, with each suit including a plurality of sequentially denominated cards, and said predetermined multi-card arrangement comprises three or four of a kind.

74. The method of claim 72, wherein said deck of playing cards is divided into at least four different suits, with each suit including a plurality of sequentially denominated cards, and said predetermined multi-card arrangement comprises a run of three or more sequential suited cards.

75. The method of claim 64, wherein a plurality of predetermined multi-card arrangements of cards have a zero point count value.

76. The method of claim 75 wherein said deck of playing cards is divided into at least four different suits, with each suit including a plurality of sequentially denominated cards, and said plurality of predetermined multi-card arrangements of cards comprise three or four of a kind and runs of three or more sequential suited cards.

77. The method of claim 64, further comprising the step of each player placing an ante wager before said step of dealing at least one initially incomplete player hand.

78. The method of claim 64, further comprising the step of settling bets with remaining players after said step of comparing.

79. The method of claim 78, wherein said step of settling bets includes the step of paying each winning player according to the odds set forth in the following table depending upon the point count value of each winning player hand:

| Point Count Value of Winning Hand | Payoff odds |
|---|---|
| 16–20 | 2 to 1 |
| 11–15 | 3 to 1 |
| 6–10 | 4 to 1 |
| 1–5 | 8 to 1 |
| 49 | 10 to 1 |
| 50 | 20 to 1 |
| 0 | 100 to 1 |
| All Other | 1 to 1 |

80. The method of claim 78, wherein said step of settling bets includes the step of paying each winning player a bonus amount depending upon the point count value of each winning player hand.

81. The method of claim 64, wherein said game is played on an electronic device and said cards comprise electronically produced visual representations of playing cards.

82. The method of claim 64, wherein said game is played in a live form on a gaming table with a human dealer and conventional playing cards.

83. The method of claim 64, further comprising the step of cancelling said bets if the dealer hand does not achieve a predetermined point count value.

* * * * *